US006601645B1

(12) United States Patent
Abdo

(10) Patent No.: US 6,601,645 B1
(45) Date of Patent: Aug. 5, 2003

(54) SPEAKER HEAT SINK

(76) Inventor: Nasser A. Abdo, 19232 Parker Cir., Villa Park, CA (US) 92861

( * ) Notice: Subject to any disclaimer, the term of this patent is extended or adjusted under 35 U.S.C. 154(b) by 0 days.

(21) Appl. No.: 10/127,819

(22) Filed: Apr. 23, 2002

(51) Int. Cl.[7] ..... F28F 7/00
(52) U.S. Cl. ..... 165/185; 165/80.2; 361/704
(58) Field of Search ..... 165/185, 80.3, 165/80.2; 381/397; 361/704

(56) References Cited

U.S. PATENT DOCUMENTS

| | | | | | |
|---|---|---|---|---|---|
| 1,976,868 | A | * | 10/1934 | Voorhees | 381/379 |
| 3,205,936 | A | * | 9/1965 | Katz | 165/185 |
| 4,103,192 | A | * | 7/1978 | Wendt et al. | 165/185 |
| 4,443,667 | A | * | 4/1984 | Hunt | 179/115 R |
| 4,465,905 | A | * | 8/1984 | Nation | 179/115.5 PC |
| 5,060,716 | A | * | 10/1991 | Heine | 165/185 |
| 5,450,499 | A | * | 9/1995 | Morris, Sr. et al. | 381/192 |
| 5,748,760 | A | * | 5/1998 | Button | 381/199 |

* cited by examiner

*Primary Examiner*—Henry Bennett
*Assistant Examiner*—Terrell McKinnon
(74) *Attorney, Agent, or Firm*—Irving Keschner

(57) ABSTRACT

A heat sink for dissipating the heat generated by a loudspeaker voice coil. The heat sink comprises a multi-piece, aluminum based structure bolted together and which encompasses the speaker motor structure. In a first embodiment, the heat sink comprises a plurality of spaced apart and separate, concentric disk shaped ring members, formed in segments, each segment being fastened together. In a second embodiment, the heat sink comprises a plurality of concentric disk shaped ring members formed in segments, each segment being fastened together. In each embodiment, the assembled heat sink is positioned over the speaker motor structures. The heat sink extracts excess energy from the speaker motor structure and dissipates that energy in the form of heat into the surrounding air enabling the speaker voice coil to perform within the normal/safe operating temperature and allows for greater handling capabilities. The heat sink also increases the mechanical strength of the motor structure, increasing speaker life and ensures that the motor structure will not deform or shift maintaining the motor structure components in alignment.

9 Claims, 5 Drawing Sheets

SPEAKER HEAT SINK

BACKGROUND OF THE INVENTION

1. Field of the Invention

The present invention provides a heat sink that encompasses a speaker magnet structure in order to dissipate heat energy into the surrounding air.

2. Description of the Prior Art

Modern day vehicle audio systems incorporate amplifiers (usually positioned in the trunk of the vehicle) that typically produce in excess of 1000 watts RMS (or continuous) power which, when applied to a voice coil of a woofer, or speaker, produces large amounts of heat. This heat is capable of melting the voice coil wire if the heat is not extracted and dissipated. In addition, the initial ambient temperature of the speaker's motor structure in the trunk of a dark colored vehicle, when the outside temperature is in excess of 100° F., may exceed 160° F., another factor that can damage the speaker.

Conventional speakers utilize the dense composite ferrite material of the magnet structure and the steel top plate and T-Yoke of the speaker to dissipate the generated heat. However, the heat dissipation occurs at a relatively slow rate.

What is desired is to provide a structure adapted for use with vehicle speakers that increases the dissipation rate of the heat generated by the speaker amplifiers.

SUMMARY OF THE PRESENT INVENTION

The present invention provides a heat sink for dissipating the heat generated by the voice coil incorporated in a vehicle audio speaker. The shield comprises a multi-piece, aluminum based structure bolted together and which encompasses the speaker motor structure. In a first embodiment, the heat segment comprises a plurality of spaced apart and separate, concentric disk shaped aluminum ring members formed in segments, each segment being fastened together. In a second embodiment, the heat sink comprises a plurality of concentric disk shaped aluminum ring members formed in segments, each segment being fastened together. In each embodiment, the assembled heat sink is positioned over the speaker motor structure.

The heat sink of the present invention extracts excess energy from the speaker motor structure and dissipates that energy in the form of heat into the surrounding air. This enables the speaker voice coil to perform within the normal/safe operating temperature and allows for greater power handling capabilities. The heat sink also increases the mechanical strength of the motor structure, increasing speaker life and ensures that the motor structure will not deform or shift maintaining the motor structure components in alignment.

DESCRIPTION OF DRAWINGS

For better understanding of the present invention as well as other objects and further features thereof, reference is made to the following description which is to be read in conjunction with the accompanying drawing therein.

DESCRIPTION OF THE INVENTION

Figure 1:
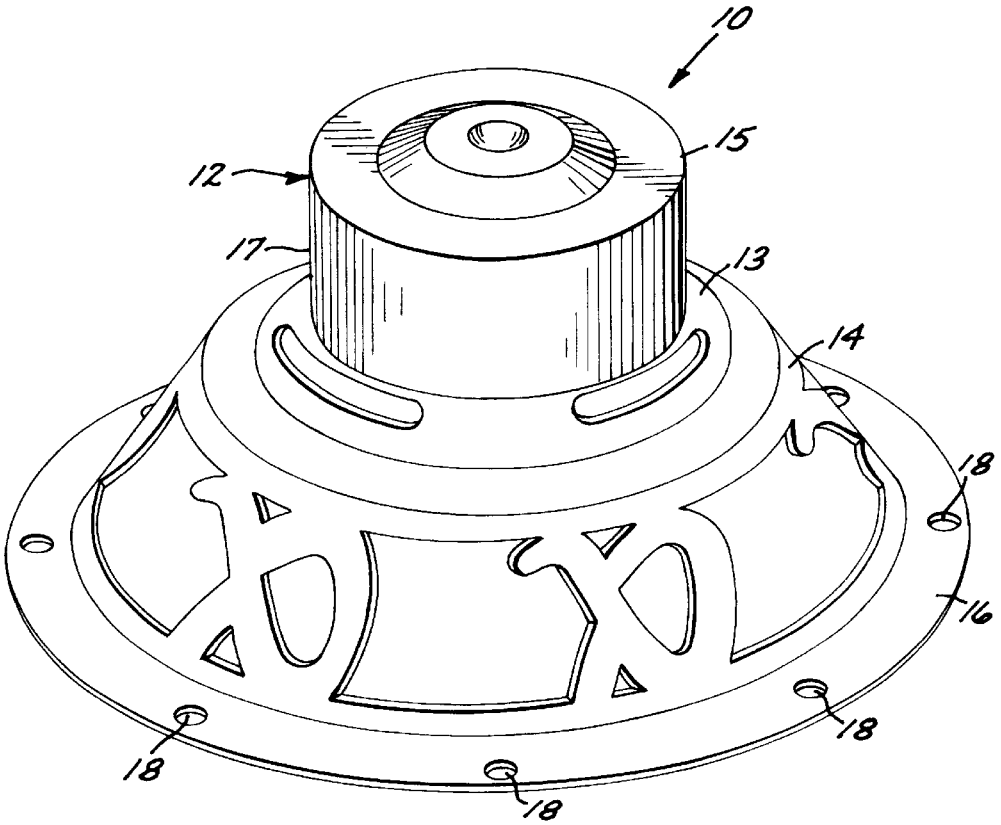
FIG. 1 PRIOR ART
FIG. 1 is a perspective view of a conventional vehicle speaker.

Referring now to FIG. 1, a perspective view of a commercially available speaker 10 in which the heat sink of the present invention is adapted for use is illustrated. The specific design of speaker 10 is disclosed in copending application Ser. No. 10/021488, filed Oct. 22, 2001, entitled "Improved Vehicle Speaker" and assigned to the assignee of the present invention. The teachings of the aforementioned application necessary for an understanding of the invention are incorporated herein by reference.

Speaker 10 includes an upper portion 12, commonly referred to as a motor structure, which incorporates a top plate 13, bottom plate (or T-yoke) 15, magnet(s) 17 and a voice coil (not shown) positioned adjacent diaphragm support 14. The bottom flange member 16 of support 14 has a plurality of fastening holes 18 formed therein.

Referring now to FIGS. 2–5, a first embodiment of the heat sink 30 of the present invention is illustrated.

Figure 2:
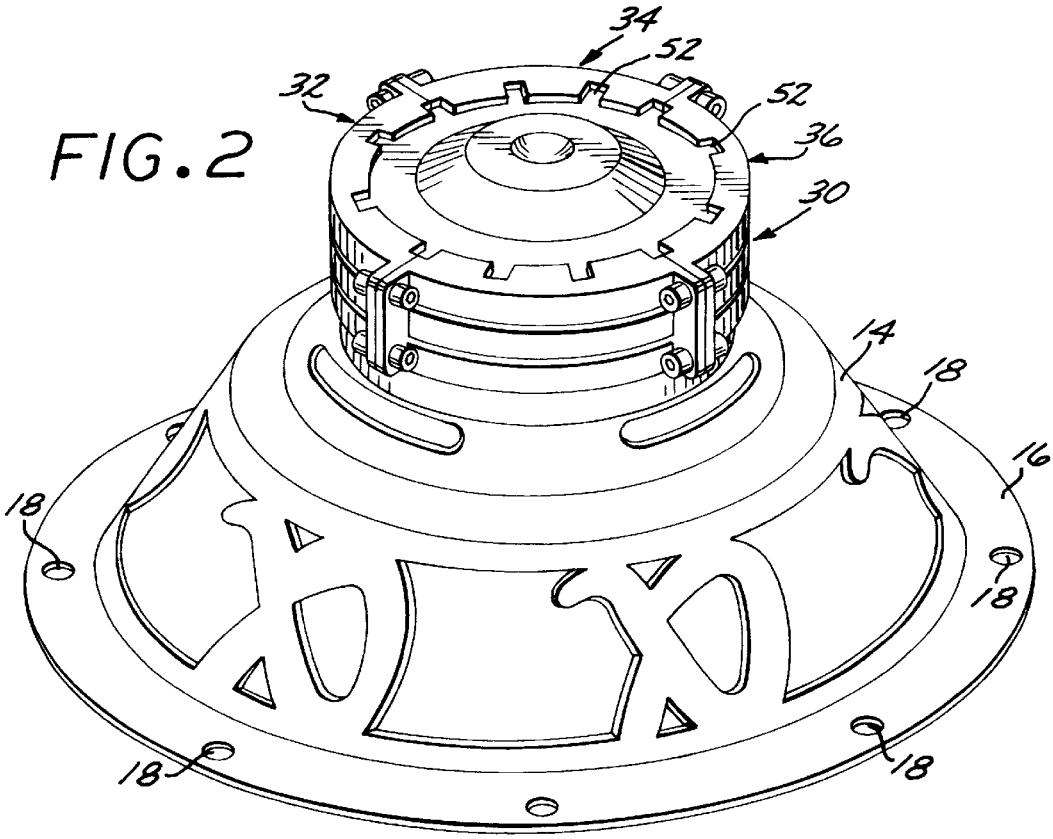
FIG. 2 is a perspective view of a vehicle speaker cooled by a first embodiment of the heat sink of the present invention.
Figure 3:
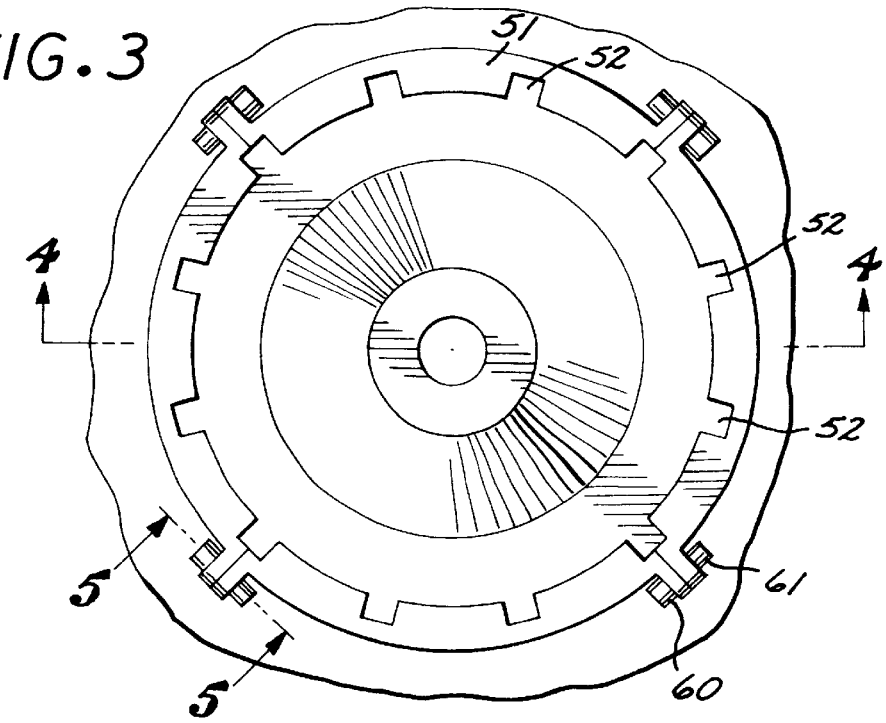
FIG. 3 is a top view of the speaker shown in FIG. 2.
Figure 7:
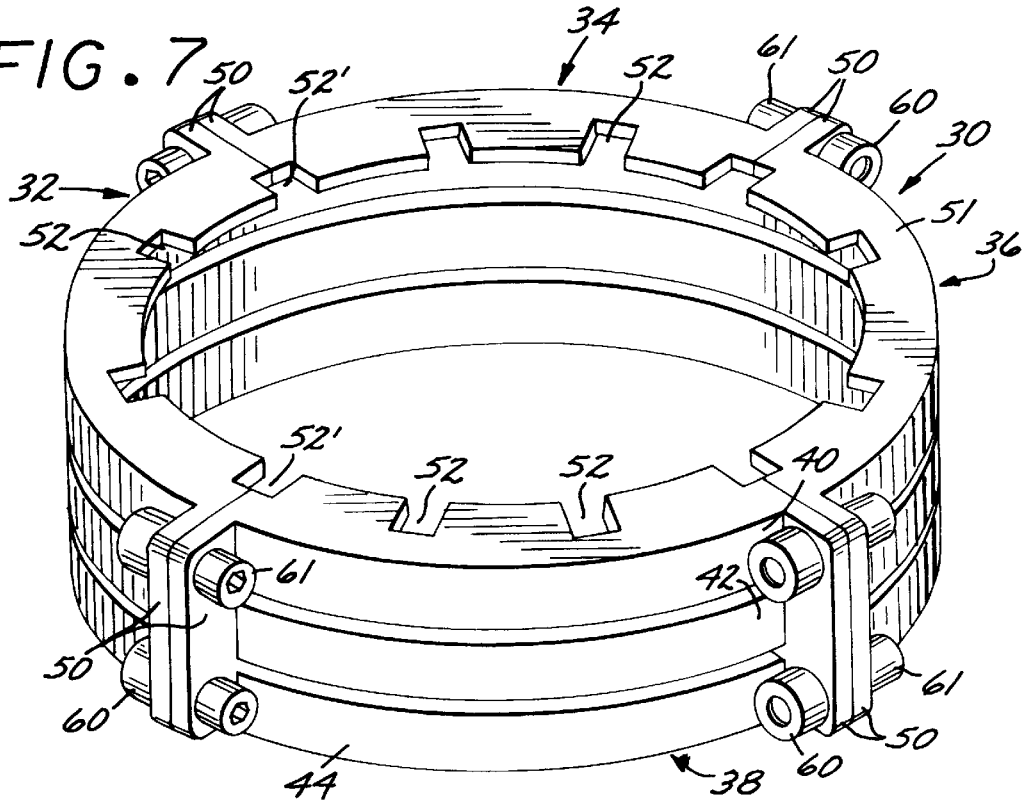
FIG. 7 is a perspective view of the first embodiment of the novel heat sink of the present invention.
Figure 8:
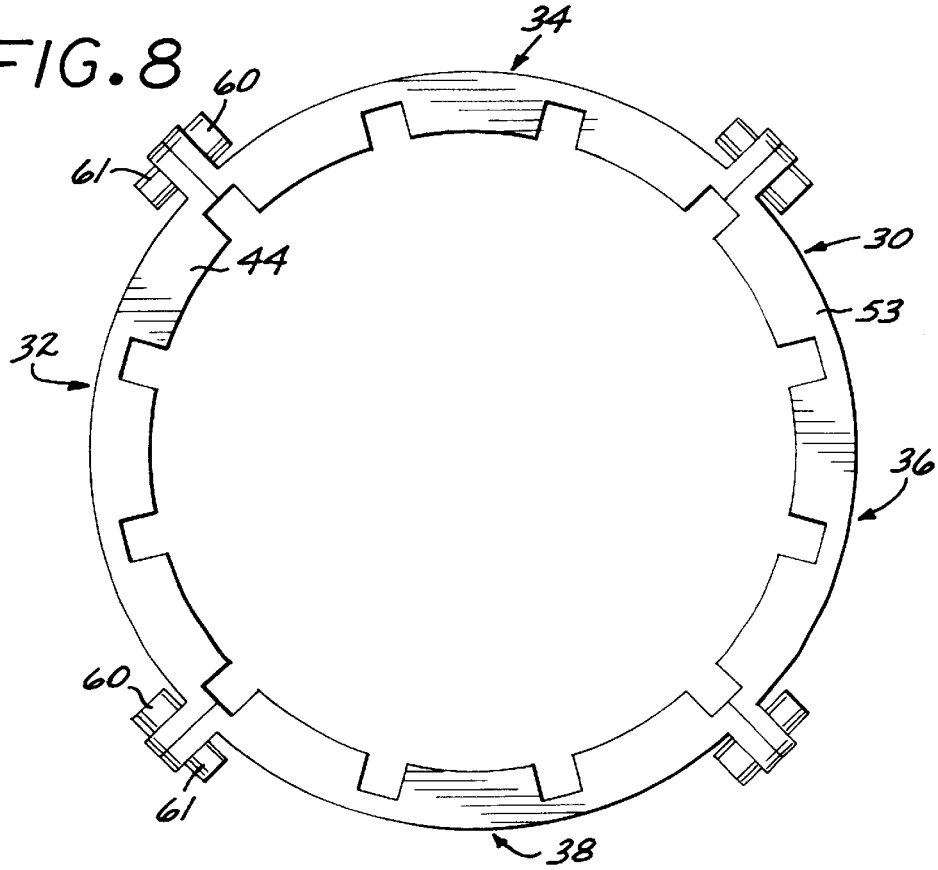
FIG. 8 is a top view of the heat sink shown in FIG. 7.

Heat sink 30 (shown in more detail in FIGS. 7 and 8) comprises a plurality of spaced apart, disk shaped segments 32, 34, 36 and 38 shown in FIG. 2, each segment comprising three concentric, disk shaped metal rings (although four segments and three rings per segment are illustrated, more or less segments and rings may be utilized) 40, 42 and 44. The preferred metal is aluminum and the multi-piece (four segments illustrated) heat sink 30 is made from either a cast or CNC process. The four segments have flange portions 50 at each end, each flange portion 50 having apertures formed therein. The flange portions 50 join the individual rings in each segment together. In particular, segments 32 and 34 are coupled together by a first pair of flanges 50; segments 32 and 38 are coupled together by a second pair of flanges 50; segments 34 and 36 are coupled together by a third pair of flanges 50; segments 36 and 38 are coupled together by a fourth pair of flanges 50; and segments 32 and 38 are coupled together by the second pair of flanges 50. The upper surfaces 51 and lower surfaces 53 of rings 40, 42 and 44 have a plurality of notches 52 formed therein as illustrated for decorative purposes (the joined flange end portions form a notch 52 as illustrated). The segments are joined together by fasteners, such as bolts 60 and nuts 61. The rings 40, 42 and 44 are separate and spaced apart from each other as illustrated.

After the segments are bolted together, the resulting heat sink 30 is positioned over the motor structure 12. Although not illustrated, the present invention contemplates the addition of cooling fins which extend from the outside surface of each concentric ring segment.

Figure 4:
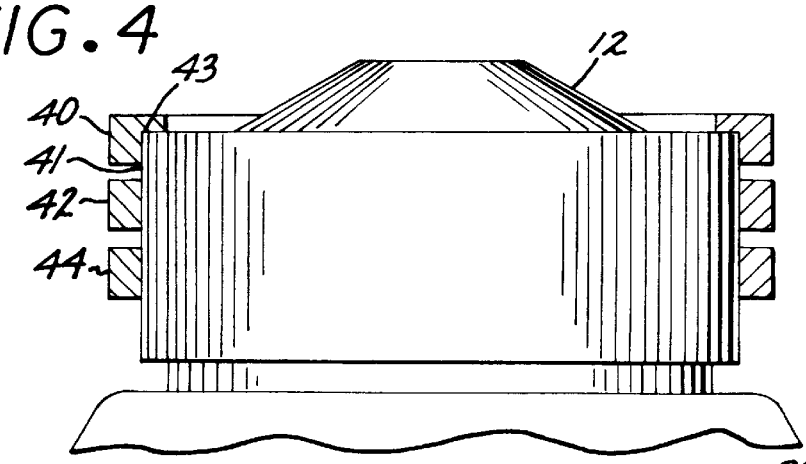
FIG. 4 is a cross-sectional view along line 4—4 of FIG. 3.

FIG. 4 is a cross-sectional view showing how the exterior cylindrical surface 41 of motor structure 12 is positioned within the annular inner notch 43 formed in ring 40.

Figure 5:
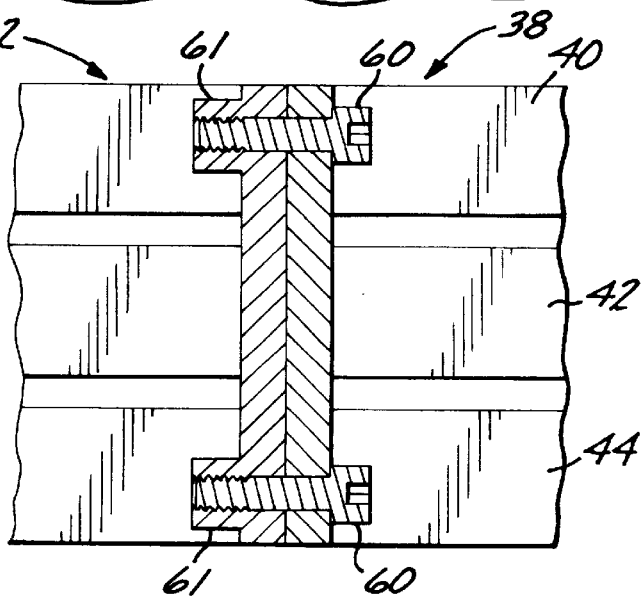
FIG. 5 is a cross-sectional view along line 5—5 of FIG. 3.

FIG. 5 is a cross-sectional view illustrating how segments 32 and 38 are joined together using bolts 60 and nuts 61.

Figure 6:
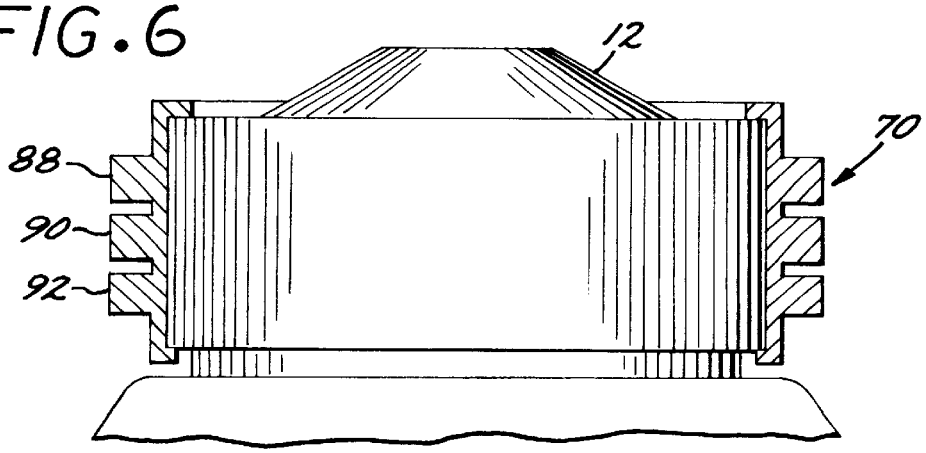
FIG. 6 is a view, similar to FIG. 4, showing a second embodiment of the heat sink of the present invention.
Figure 9:
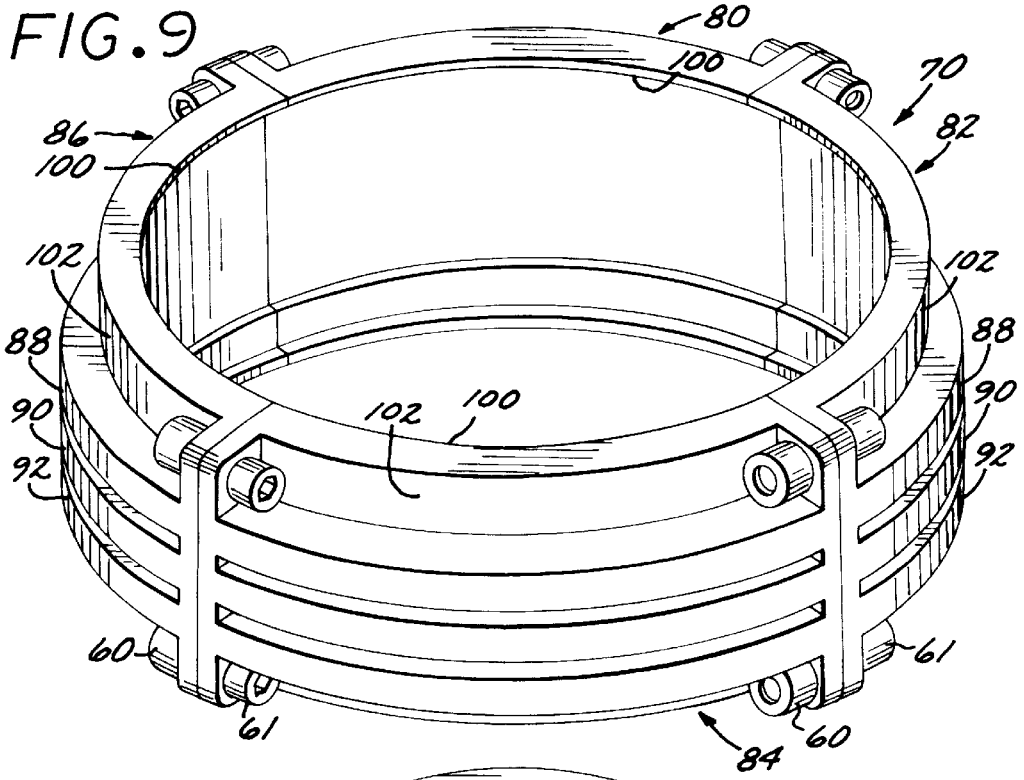
FIG. 9 is a perspective view of a second embodiment of the novel heat sink of the present invention.
Figure 10:
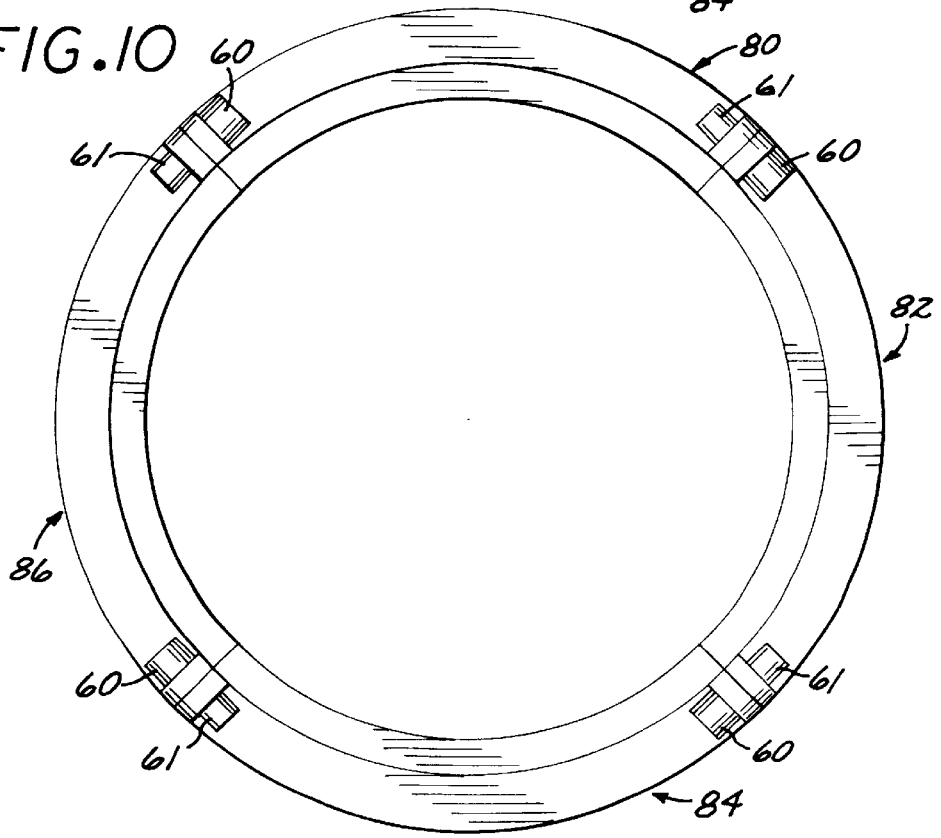
FIG. 10 is a front elevation al view of the heat sink shown in FIG. 9.

FIGS. 6, 9 and 10 illustrate a second embodiment 70 of the heat sink of the present invention (the same reference numerals identify identical components in each figure). Heat sink 70 is similar to heat sink 30 in that it comprises four segments 80, 82, 84 and 86, each segment comprising three disk shaped ring members 88, 90 and 92 formed on the exterior surface of each segment 80, 82, 84 and 86. The segments are joined together by fastener assemblies comprising bolt 60 and nut 61. In this embodiment, ring members 88, 90 and 92 although spaced from each other, are in essence coupled together via heat conducting surface 102 of cylindrical portions 100.

FIG. 6 is a cross-sectional view, similar to FIG. 4, showing heat sink 70 positioned over woofer motor structure 12.

The present invention thus provides a relative simple and inexpensive system for dissipating heat generated by a vehicle speaker.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A heat sink for use with a vehicle audio speaker comprising a first plurality of disk shaped members, said members having first and second end portions, said first and second end portions of said disk shaped members being coupled together by first and second flange members, respectively;

a second plurality of disk shaped members positioned adjacent said first plurality of disk shaped members, said second plurality of disk shaped members having first and second end portions, said first and second end portions of said second plurality of disk shaped members being coupled together by third and fourth flange members, respectively; and means for joining said first flange member of said first plurality of disk shaped members to said third flange member of said second plurality of said disk shaped members.

2. The heat sink of claim 1 further including a third plurality of disk shaped members positioned adjacent said first plurality of disk shaped members, said third plurality of disk shaped members having first and second end portions, said end portions of said third plurality of disk shaped members being coupled together by fifth and sixth flange members, respectively.

3. The heat sink of claim 2 further including means for joining said second flange member of said second plurality of disk shaped members to said fifth flange member of said third plurality of disk shaped members.

4. The heat sink of claim 3 wherein each disk shaped member is spaced apart and separate from an adjacent disk shaped member.

5. The heat sink of claim 3 wherein each disk shaped member is coupled to an adjacent disk shaped member by a heat conducting surface.

6. The heat sink of claim 3 wherein said heat sink surrounds a portion of said audio speaker.

7. A heat sink for use with a vehicle audio speaker comprising a first disk shaped segment comprising a plurality of ring shaped members, said ring members having first and second end portions, said first and second end portions of said ring shaped members being coupled together by first and second flange members, respectively;

a second segment comprising a plurality of ring shaped members positioned adjacent said first plurality of ring shaped members, said second plurality of disk shaped members having first and second end portions, said first and second end portions of said second plurality of ring shaped members being coupled together by third and fourth flange members, respectively; and means for joining said first flange member of said first plurality of ring shaped members to said third flange member of said second plurality of said ring shaped members.

8. The heat sink of claim 7 wherein each ring shaped member is spaced apart and separate from an adjacent ring shaped member.

9. The heat sink of claim 7 wherein each ring shaped member is coupled to an adjacent ring shaped member by a heat conducting surface.

* * * * *